United States Patent [19]

Reil

[11] Patent Number: 4,462,202

[45] Date of Patent: Jul. 31, 1984

[54] APPARATUS FOR FORMING LIQUID FILLED PACKAGES

[75] Inventor: Wilhelm Reil, Bensheim-Auerbach, Fed. Rep. of Germany

[73] Assignee: Tetra Pak Development, S.A., Fed. Rep. of Germany

[21] Appl. No.: 484,004

[22] Filed: Apr. 14, 1983

Related U.S. Application Data

[63] Continuation of Ser. No. 198,161, Oct. 17, 1980, abandoned.

[30] Foreign Application Priority Data

Oct. 18, 1979 [DE] Fed. Rep. of Germany ..... 2942117

[51] Int. Cl.[3] ..... B65B 6/24

[52] U.S. Cl. ..... 53/526; 53/289; 53/32; 198/479

[58] Field of Search ..... 53/122, 371, 373, 526, 53/289; 198/479, 696

[56] References Cited

U.S. PATENT DOCUMENTS

| | | | |
|---|---|---|---|
| 689,474 | 12/1901 | Fales | 53/526 X |
| 2,481,611 | 9/1949 | Moore | 53/526 X |
| 2,700,939 | 2/1955 | Liston | 53/122 |
| 2,822,653 | 2/1958 | Zinn et al. | 53/373 |
| 2,876,604 | 3/1959 | Engleson et al. | 53/244 |
| 3,488,915 | 1/1970 | Delestatius | 53/511 |
| 3,674,060 | 7/1972 | Ruekberg | 53/289 X |
| 3,857,223 | 12/1974 | Dominici | 53/526 |
| 3,973,603 | 8/1976 | Franz | 53/289 X |

FOREIGN PATENT DOCUMENTS

| | | | |
|---|---|---|---|
| 2410101 | 9/1975 | Fed. Rep. of Germany | 53/371 |
| 449478 | 10/1966 | U.S.S.R. | 198/696 |

*Primary Examiner*—John Sipos

*Attorney, Agent, or Firm*—Austin R. Miller

[57] ABSTRACT

Apparatus for shaping liquid containing packages is disclosed. The apparatus comprises a take-off conveyor which includes a multitude of support parts which form a conveyor belt. The support parts are movable with respect to each other and point transversely outwardly from the conveyor path. A plunger moves out from the surface of the support part towards a side wall of the package to indent the same at a certain portion of the package formation cycle. A switch cam plate or the like causes movement of the plunger between a contact position in which the plunger contacts and indents a portion of the package and another position in which the plunger does not engage the package.

1 Claim, 4 Drawing Figures

1
2
3
4
5
6
7
8
9
10
14
15
30

APPARATUS FOR FORMING LIQUID FILLED PACKAGES

This application is a continuation, of application Ser. No. 198,161, filed Oct. 17, 1980, now abandoned.

BACKGROUND OF THE INVENTION

1. Field of the Invention

The present invention pertains to a device for shaping liquid-filled packages of plastic laminated cardboard carrier material which has been preformed along one side. The packages are produced from a hose by transversal and longitudinal sealing, with a take-off conveyor being provided to support a series of sequentially arranged packages and with a support part and cooperating plunger being provided to indent each package during the formation process.

2. Discussion of the Prior Art

One device of the general type described above is known from DE-OS 2 410 101. In this device, the serially arranged, and filled, packages (preformed along one side) are pushed onto a take-off platform which constitutes one of several support parts. At the shaping station above the bearing plate, the shaping plunger and pressure finger are movable and are arranged in such manner that the shaping chamber is functionally completely closed only during the shaping process and the pressure fingers move up together with the shaping plunger after the end of the shaping period to free the way for new packages. This familiar equipment allows precise shaping and high cycle speeds but requires considerable expenditure for constructional engineering.

SUMMARY OF THE INVENTION

An object of the present invention is to simplify the package shaping equipment as described above in order to obtain an even sturdier machine. This and other objects are met by the present invention in that the take-off conveyor comprises a multitude of support parts which form a conveyor belt. The support parts are movable with respect to each other, and point transversely outward from the conveyor path. A plunger moves out from the surface of the support part towards a side wall of the package. In contrast to the familiar shaping equipment in which the bearing plates of the shaping station are on the level of the bottom of the take-off conveyor and in which the packages are pushed in close contact in a row into the shaping station, the present invention provides movable support parts with the features described, which each take one filled package and advance it into the shaping station, while a further treatment, that is the indentation of each package by plungers during the shaping process, is applied.

In the case of the heretofore known equipment, a fixed plunger is provided and movable pressure fingers and support parts press against the plunger in the shaping station. In the present invention, however, the plunger is movable, that is, it can be moved from one position in which it is retracted completely into the surface of the take-off conveyor and has no function, into a second position in which it presses against the side wall of the package to further facilitate the shaping of the upper package parts. In a very simply designed shaping station, for instance, in one in which a plunger moves from above, downwardly onto a not yet shaped package and applies pressure, wrinkling in the walls of the upper part of the package may result making the desired final shaping impossible. This is caused by the instability of the package which is only preformed on one side thereof. If one, however, applies pressure to the package by the plunger to decrease the volume, then the simultaneously acting shaping plunger can shape the package in the shaping station in the desired manner. Thus, the shaping chamber which surrounds the respective package becomes for all practical reasons smaller in volume because the plunger has emerged from the surface of the respective support part. The package gains stability in this way since the fluid pressure increases due to identation of one side wall and this guarantees a better folding process.

In accordance with this invention it is of further advantage if the support part has the shape of an angle plate hinged at the conveyor chain. Furthermore, the present invention provides that in each support part a plunger is set and is capable of being directed in such way that is emerges from the surface of this support part on a portion of the conveyor track. In this way a continuous sequence of parts is formed, representing a chain belt of the mentioned support parts and plungers.

The filled package, which has been preformed along one side, is led to the angle plate support part and, if necessary, advanced on a separate conveyor device. In the course of this motion, the package is preferably surrounded on all sides by supporting walls in order to be formed completely on the second side by a subsequent, very simple shaping station. In this condition, that is when the package is still on the take-off conveyor and preferably only on this portion of the conveyor track, the plunger emerges from the surface of the support path and indents the adjacent side wall of the package to decrease the package volume.

The preferred version described above can be designed with further advantage if in a portion of the top-protruding arm of the support part, a recess is provided to take up the plunger which is respectively pivoted on the conveyor chain and has two lever arms. The plunger is designed in accordance with the desired purpose of the take-off conveyor. Preferably, the essential parts of the conveyor track are arranged horizontally and the plunger comprises two lever arms disposed at an angle preferably between 90° and 150° more preferably 135° to each other. One lever arm has the function of the pushing plunger, while the other is the control lever.

According to this invention it is advantageous, that the take-off conveyor carries at least one sequence switch cam plate adapted for interaction with the control lever of the plunger. The control lever arm, if so designed and positioned, causes the plunger to disappear into the recess of the respective support part, so that the package entering or located in the support part touches only the walls of the support part, except on that portion of the conveyor track, where the forming in the forming station takes place. In this area of the conveyor track is situated the sequence switch cam plate which is preferably laid out as a hinged, spring-loaded surface against which the control lever arm abuts in the course of the movement of the take-off conveyor. In this way, a very sturdy machine results, which greatly facilitates and stabilizes the shaping of, for instance, the upper portion of a yet only at the lower side formed package.

In the design described above, the pivoted plungers have lever arms which are balanced in regard to their weight so that they emerge from the surface of the support part in the described way only in a certain desired portion of the conveyor track, while in the remaining upper strand of the take-off conveyor, they remain in retracted position merely by a weight. At both transitions from upper to lower strand (or visa versa) of the take-off conveyor, the plungers can freely pivot, hang or stand in any desired position, since they have there as well as in the lower strand, no transporting or forming function. In longer take-off conveyors, for instance, 32 supporting parts and 32 plungers respectively, provided.

Another feature of this invention provides for reduction of the multitude of plungers. This design is characterized by a plunger being linearly movable in a recess of the support part. At a desired position of the conveyor track, the plunger, which should preferably have a rectilinear design, moves from below between the drive members of the conveyor chain through a clearance in the support part to indent the side wall of the package in the described manner. The fully extended position is reached in the region of the shaping station. After this, the plunger is retracted by an appropriate control, so that it remains until the next cycle in a position in the take-off conveyor where no working function is interfered with.

DRAWINGS

DETAILED DESCRIPTION OF THE INVENTION

Figure 1:
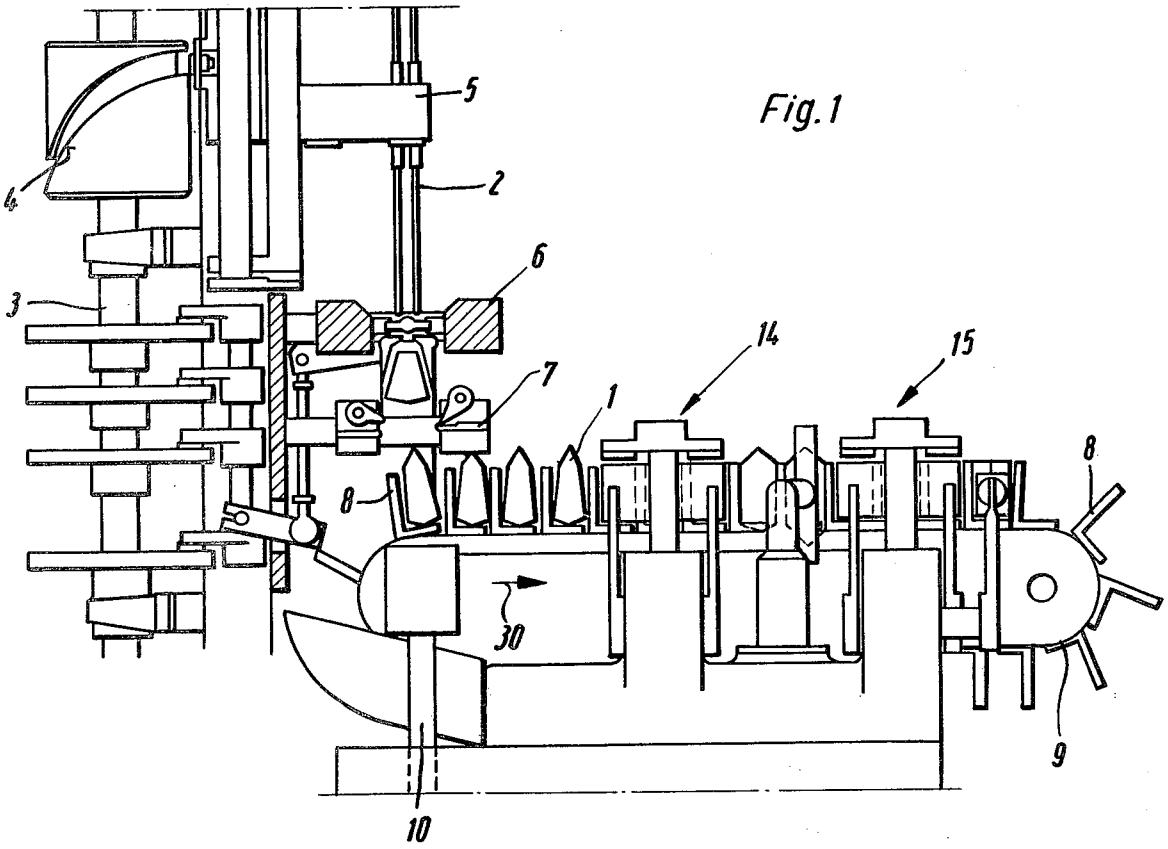
FIG. 1 is a schematic view showing a portion of the machine for filling, sealing, and separation of liquid packages highlighting the take-off conveyor and associated forming and shaping stations.

In the following detailed description a preferred embodiment of the invention is described:

The left-hand portion of FIG. 1 shows a portion of the machine for the production of packages which are preformed along one side thereof. Preferably, the packages 1 are parallelepiped in shape and are manufactured from a hose 2 which, in turn, is made from a not-depicted folded band shaped into a hose by longitudinal sealing of the aligned edges. The filling liquid is fed into the hose 2 from above and the closing and package separation takes place in a stepped cycle. The general drive mechanism consists of a vertical spindle 3 by which, for example, a roller curve 4 is driven. This, in turn, causes the paper feed 5 to vertically oscillate up and down. While the longitudinal sealing takes place in a station located above and not shown in the drawing, transverse sealing is being accomplished with a tool generally designated by 6, below which lies the separating device 7. From here the parallelepiped packages 1 drop individually into the support parts 8 of the take-off conveyor below, which is here generally indicated by the numeral 9. The conveyor, too, is driven by the central drive via drive shaft 10 and sprockets 11 (see FIG. 2).

Figure 4:
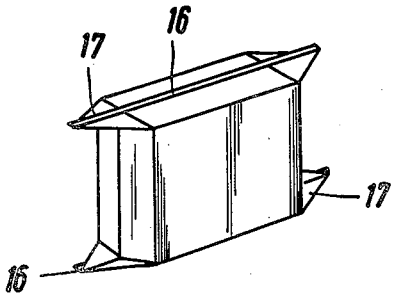
FIG. 4 is a perspective view of a package at a second stage of formation in accordance with the invention.

The take-off conveyor 9 consists mainly of two sprockets, one of which is driven. The sprockets are located a given distance from each other. The conveyor also comprises an upper strand, a lower strand, and two lateral, curved transition zones. As shown, the take-off conveyor 9 shows a multitude of support parts 8 and plungers 13, which form a conveyor chain belt 12. The plungers are not shown in FIG. 1. However, shown is the shaping station 14, which shapes the upper portion of the package 1, after the lower portion has already been preformed to the shape seen in FIGS. 1 and 4. The other parts of the take-off conveyor 9 are of secondary importance. Only the final shaping station 15 is here, in which the triangular flaps 17 seen in FIG. 5 pointing outward, are folded down and attached to complete the shaping of the parallelepiped package.

Figure 2:
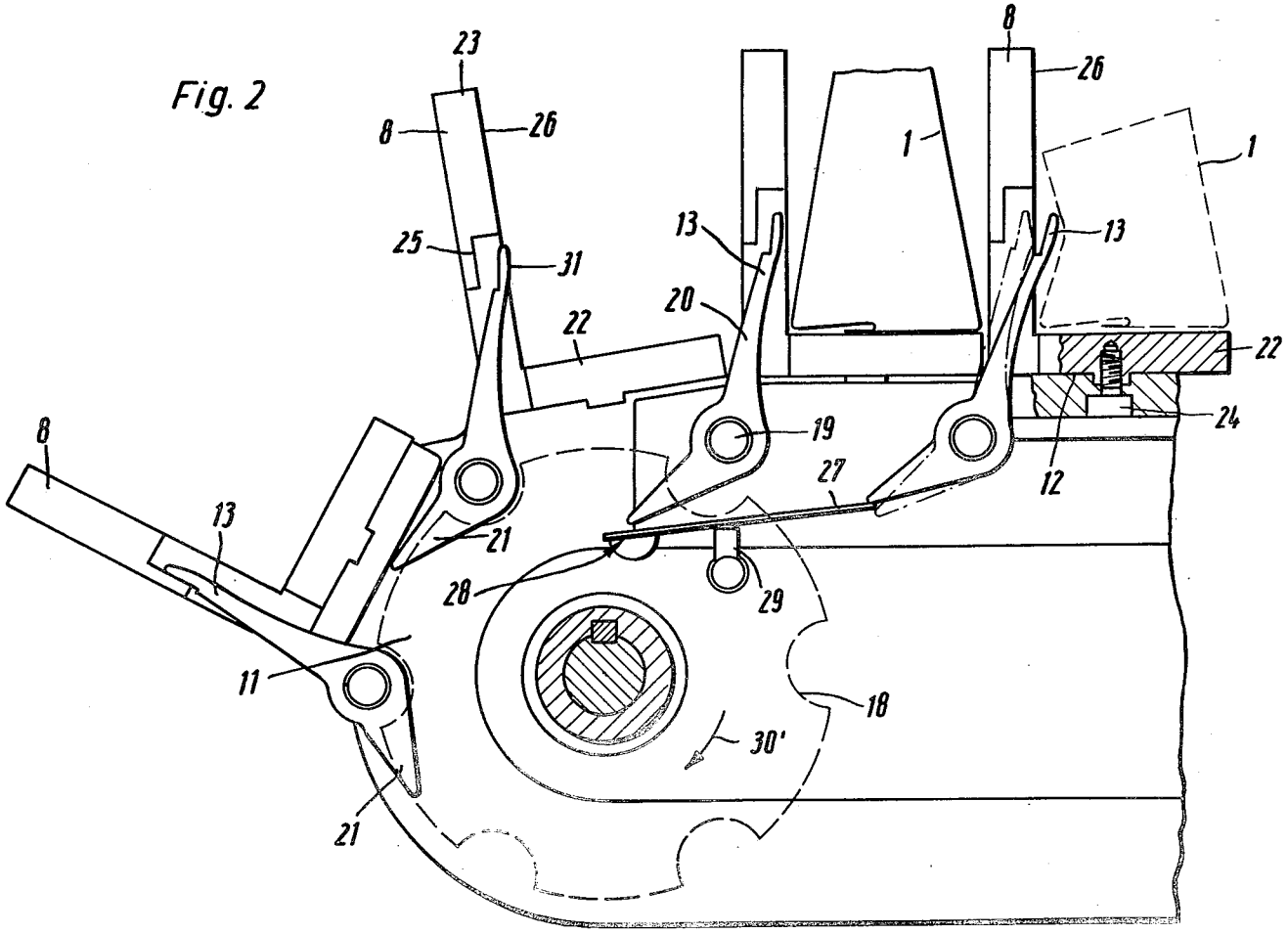
FIG. 2 is a fragmentary detail view of the left portion of the take-off conveyor shown in FIG. 1, showing one embodiment of a plunger in accordance with the invention.

FIG. 2 highlight the essential portions of the invention. The sprocket 11 has on its periphery, recesses 18 in which pins 19 engage, to drive the individual members forward as in a chain. The pins 19 also function as pivots for the plungers 13. The plungers consist of two lever arms 20 and 21, of which the latter represents the control lever arm, while the former lever arm 20 functions as the pushing device. If a hypothetical line is drawn through the lever arm 20 and the pivot of pin 19, then the control lever arm 21 protrudes by 135° counterclockwise as shown in FIG. 2. In other words, lever arm 21 forms an angle of 135° with the other lever arm 20. The weight of control lever arm 21 is, in the embodiment shown in FIG. 2, so adjusted that plunger 13 lies within contours of the support part 8 when the latter moves into action in the region of the upper strand, with the exception of a certain portion of the conveyor track, shown at the right in FIG. 2 and located below the forming station 14 as shown in FIG. 1. In the other portions of the conveyor track the position of the plunger 13 relative to the support part 8 is of no importance.

The support part 8 has the form of an L-shaped angle plate with a lower arm 22 which, in the region of the upper strand, is arranged horizontally and which is pivoted at the conveyor chain 12 by means of the bolted joint 24 shown in FIG. 2 at the right. The support part 8 is also provided with an upper arm 23 which protrudes from the conveyor track. The latter shows a recess 25 into which fits the upper arm 20 of the plunger 13 in a way that it does not significantly protrude from the contour, especially the surface 26 of the upper arm 23. Such functional states are illustrated for the three support parts 8 at the left of FIG. 1. The other state, in which the plunger 13 is shown moving out from the surface 26 of the support part 8 can be seen in the upper right of the figure. Indicated by the broken line is the package 1 shown with the left side wall indented.

The control lever arm 21 of each plunger 13 meets with the sequence switch cam plate 27 which is pivoted at 28 in the region of the left sprocket 11. The cam plate 27 is spring-loaded and supported by pin 29.

Figure 3:
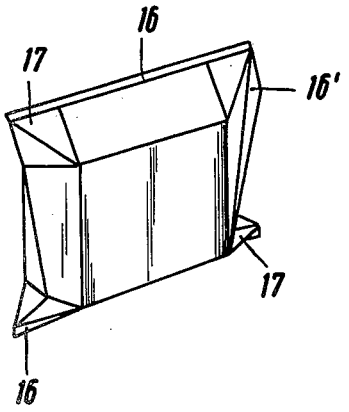
FIG. 3 is a perspective view of a package at a first stage of formation in accordance with the invention.

The operation of the invented device is described in the following:

After separation on the underside portions, the preformed package 1 drops from device 7 into the chamber formed by a support part 8 which is located farthest to the left on the horizontal strand, as shown in FIG. 1. As the take-off conveyor moves forward in the direction of the arrow 30 (FIG. 1) the package 1 has the profile shape shown to the left of the shaping chamber 14, which corresponds to the three dimensionally depicted shape of FIG. 3. Turning to FIG. 3 one can see the lower triangular flaps 17 which are already flattened, the upper triangular flaps 17 which are not fully folded yet, (resulting in the package being narrower at top), and the top transverse seam running from triangular flap to triangular flap (16). FIG. 3 also indicates the longitudinal seam 16' at the right-hand side of the package.

In the embodiment shown in FIG. 2, the left sprocket 11 turns as a drive unit in the direction of the arrow 30'. When the package enters the left support part 8, the part of the plunger 13 which protrudes only slightly at 31 from the surface 26 of the upper arm 23 of the support part 8 does not interfere. In the exaggerated showing of FIG. 2 the package 1 has an outline as shown in the upper center. The control lever arm 21 slowly moves onto the sequence switch cam plate 27, which upon further progress moves the plunger clockwise, so that the tip of the upper end of the upper plunger arm 20 touches the adjacent side wall of the package 1 and slightly indents it as shown in FIG. 2 at the upper right by a broken line. Excessive stress on the package is prevented by the spring-loaded pin 29 yielding to the sequence switch cam plate. Now the liquid in the package 1 can expect increased resistance by the walls due to the decrease in volume. When in the shaping chamber 14 a shaping plunger descends from above onto the package, the upper part of the package can be formed along the pregrooved fold lines into the shape shown in FIG. 4. When the package, thus formed in its upper and lower parts, leaves the shaping station 14 and moves as shown in FIG. 1 to the right, in the direction of arrow 30, the control lever arm 21 disengages from the sequence switch cam plate and turns counterclockwise around pivot pin 19 back to the left into recess 25 of the support part 8.

It will be appreciated that although this invention has been described in conjunction with certain specific forms and certain modifications thereof, a wide variety of other modifications can be made without departing from the spirit of the invention.

I claim:

1. Apparatus for shaping liquid-filled packages of plastic laminated cardboard carrier material at a shaping head of a packaging production line said material being produced from a hose shaped base having transverse and longitudinally oriented sealing means, comprising:

(a) conveyor means for transporting and supporting a series of sequentially arranged packages along a conveyor path to said shaping head, said conveyor means comprising a chain belt movable through an upper strand portion, a lower strand portion and two curved transition zones between said upper and lower strand portions and carrying a plurality of angle plates support means, said angle plate support means having a lower arm which is horizontal in the upper strand portion of said conveyor and an upper arm substantially perpendicular to said lower arm protruding outward from said chain belt behind the packages, each said upper arm having a recess therein;

(b) said shaping head comprising a shaping means operative to press and shape the liquid-filled packages;

(c) plunger means movably mounted on each said support means to compress and reduce the volume of one liquid-filled package while the shaping means (b) presses and shapes the one liquid filled package;

(d) each said plunger means comprising of lever means having a control arm extending out of the path of the packages and a second arm integral with and at a fixed angle to said control arm, said second arm residing in a rest position within said recess of said upper arm of said support means in said upper strand portion of said conveyor means upstream from said shaping head and in an operation pressing position protruding out of said recess;

(e) a sequence switch cam plate longitudinally extending in the direction of movement of the packages proximate said shaping head, the upstream longitudinal end of said cam plate pivotally mounted on an axle, said cam plate being spring loaded and supported by a pin downstream from said pivot point, said cam plate positioned to engage said control arm of said lever means as said support means moves along the cam plate to forwardly move said second arm of said plunger from said recess to a package engaging and pressing position at a location on said upper strand proximate said shaping head.

* * * * *